US009840101B2

(12) United States Patent
Sekimoto et al.

(10) Patent No.: US 9,840,101 B2
(45) Date of Patent: Dec. 12, 2017

(54) DROPLET EJECTION APPARATUS

(71) Applicant: FUJI XEROX CO., LTD., Tokyo (JP)

(72) Inventors: Masahiko Sekimoto, Kanagawa (JP); Shinji Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/244,049

(22) Filed: Aug. 23, 2016

(65) Prior Publication Data

US 2017/0225497 A1 Aug. 10, 2017

(30) Foreign Application Priority Data

Feb. 8, 2016 (JP) ..... 2016-021661

(51) Int. Cl.
*B41J 29/377* (2006.01)

(52) U.S. Cl.
CPC ..... *B41J 29/377* (2013.01)

(58) Field of Classification Search
CPC ..... B41J 29/377
See application file for complete search history.

(56) References Cited

U.S. PATENT DOCUMENTS

2011/0109710 A1* 5/2011 Miyakoshi ..... B41J 2/165 347/104
2013/0307895 A1 11/2013 Shimizu et al.
2016/0101622 A1* 4/2016 Sakata ..... B41J 2/165 347/25
2016/0167380 A1* 6/2016 Andres ..... B41J 2/165 347/40

FOREIGN PATENT DOCUMENTS

JP 2011-161885 8/2011
JP 2013-240905 12/2013

OTHER PUBLICATIONS

Abstract and machine translation of JP 2011-161885.

* cited by examiner

*Primary Examiner* — Alessandro Amari
*Assistant Examiner* — Roger W Pisha, II
(74) *Attorney, Agent, or Firm* — Fildes & Outland, P.C.

(57) ABSTRACT

Provided is a droplet ejection apparatus including: an ejecting mechanism in which plural ejection units which eject droplets from a nozzle to a transported recording medium are disposed in a zig-zag form in an intersection direction that intersects a transport direction of the recording medium; and a release unit which releases humidified air from a release port which is open in the recording medium side between ejection units in the intersection direction.

8 Claims, 7 Drawing Sheets

DROPLET EJECTION APPARATUS

CROSS-REFERENCE TO RELATED APPLICATIONS

This application is based on and claims priority under 35 USC 119 from Japanese Patent Application No. 2016-021661 filed Feb. 8, 2016.

BACKGROUND

Technical Field

The present invention relates to a droplet ejection apparatus.

SUMMARY

According to an aspect of an exemplary embodiment of the invention, here is provided a droplet ejection apparatus including:

an ejecting mechanism in which plural ejection units which eject droplets from a nozzle to a transported recording medium are disposed in a zig-zag form in an intersection direction that intersects a transport direction of the recording medium; and a release unit which releases humidified air from a release port which is open in the recording medium side between ejection units in the intersection direction.

BRIEF DESCRIPTION OF THE DRAWINGS

Exemplary embodiments of the present invention will be described in detail based on the following figures, wherein.

DETAILED DESCRIPTION

Below, an example of the exemplary embodiments of the invention will be described with reference to the drawings.

Image Forming Apparatus 10

Figure 1:
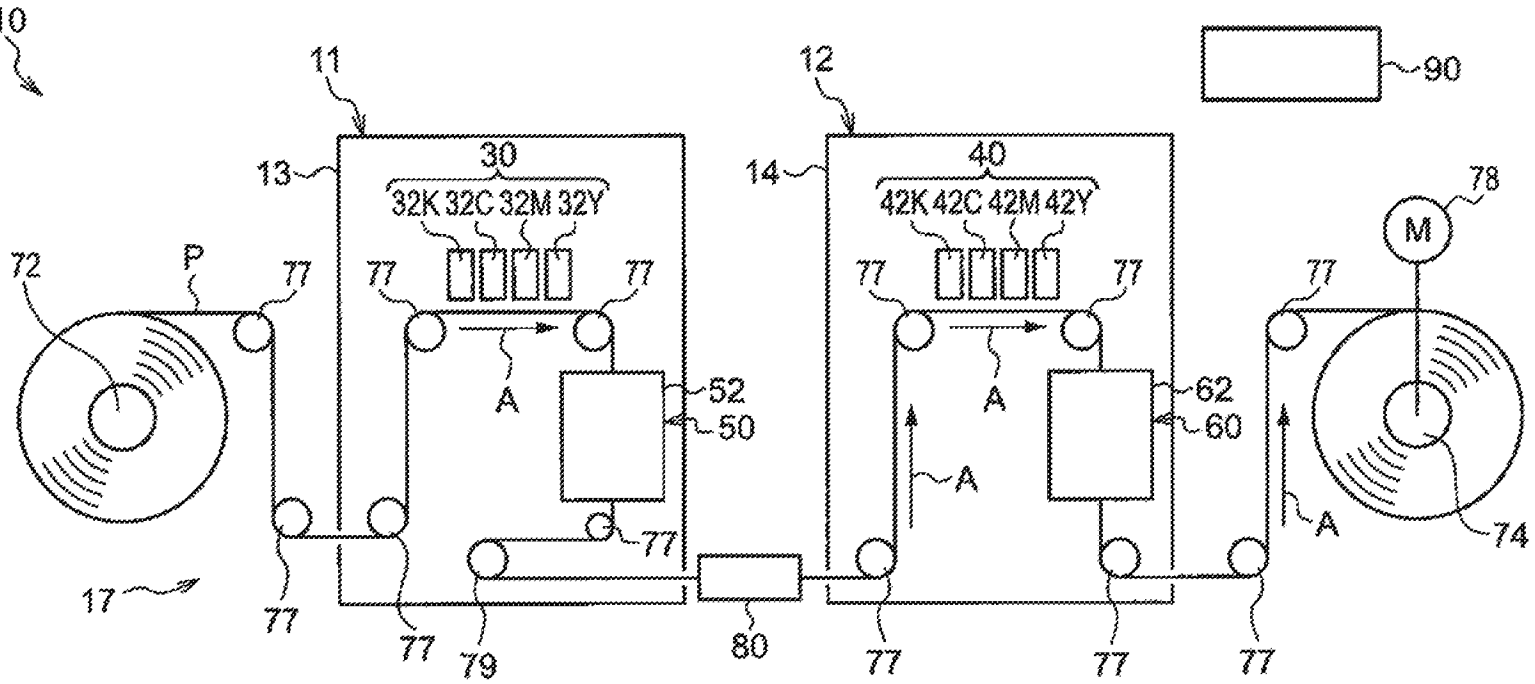
FIG. 1 is a schematic diagram illustrating a configuration of an image apparatus according to an exemplary embodiment.

First, the is forming apparatus 10 as an example of a droplet ejection apparatus that ejects droplets will be described. FIG. 1 is a schematic diagram illustrating the configuration of the image forming apparatus 10.

As illustrated in FIG. 1, the image forming apparatus 10 is provided with a first image forming apparatus 11 that forms an image on the surface of a continuous paper P (example of a recording medium), a second image forming apparatus 12 that forms an image on the rear surface of the continuous paper P, a transport mechanism 17 that transports the continuous paper P, and a controller 90 that controls each portion of the image forming apparatus 10.

Transport Mechanism 17

The transport mechanism 17 includes a reel-out roll 72 that reels out the continuous paper P, a winding roll 74 that winds up the continuous paper P, a reversing mechanism 80 that causes the front and rear of the continuous paper P to be reversed, and plural transport rolls 77 that transport the continuous paper P. The winding roll 74 is driven to rotate by a driving unit 78. Accordingly, the winding roll 74 winds up the continuous paper P and the reel-out roll 72 reels out the continuous paper P.

The plural transport rollers 77 wound by the continuous paper P between the reel-out roll 72 and the winding roll 74. Accordingly, the transport path of the continuous paper P from the reel-out roll 72 to the winding roll 74 is determined. The plural transport rollers 77 is driven to follow the continuous paper P that proceeds to the winding roll 74 side by the winding roll 74 winding up the continuous paper P.

In the exemplary embodiment, the first image forming apparatus 11 is disposed on the upstream side (reel-out roll 72 side) in the transport path from the reel-out roll 72 to the winding roll 74, and the second imago forming apparatus 12 is disposed on the downstream side (winding roll 74 side).

The reversing mechanism 80 is disposed between the first image forming apparatus 11 and the second image forming apparatus 12 on the transport path from the reel-out roll 72 to the winding roll 74. Accordingly, after the reversing mechanism 89 causes the front and rear of the continuous paper P passing through the first image forming apparatus 11 while borne reeled out by the reel-out, roll 72 to be reversed, and the continuous paper P for which the front and rear are reversed passes through the second image firming apparatus 12, the continuous paper P is wound up by the winding roll 74. In each drawing, the transport direction of the continuous paper P (below, may also be simply referred to as, "transport direction") is indicated, as appropriate, by the arrow A.

First Image Forming Apparatus 11

The first image forming apparatus 11 is provided with an image forming apparatus main body 13 (housing), a first ejection unit 30 that ejects ink droplets (example of droplets) on the continuous paper P, a first drying unit 50 which causes the ink droplets ejected on the continuous paper P to dry, and a cooling roll 79 that cools the continuous paper P.

The first ejection unit 30, the first drying unit 50, and the cooling roll 79 are disposed in this order from the upstream side in the transport direction of the continuous paper P toward the downstream side. Accordingly, the ejecting operation, the heating operation, and the cooling operation are executed in this order with respect to each portion of the continuous paper P transported by the transport mechanism 17.

First Ejection Unit 30

The first ejection unit 30 includes first ejection heads 32Y, 32M, 32C, and 32K that eject each of yellow (Y), magenta (M), cyan (C), and black (K) ink droplets on the continuous paper P. An image is formed on the continuous paper P by each color of ink droplet being ejected on the continuous paper P from the first ejection heads 32Y, 32M, 32C, and 32K (below, referred to as 32Y to 32K).

First Drying Unit 50

The first drying unit 50 includes a housing 52 and an infrared ray heater (not shown) as a heat source disposed in the interior of the housing 52. Plural infrared ray heaters (not shown) are disposed along the vertical direction facing the image forming surface (surface on which ink droplets are ejected from the first ejection unit 30) of the continuous paper P transported in the interior of the housing 52. In the first drying unit 50, the ink on the image forming surface is dried by the plural infrared ray beaters (not shown) heating the image forming surface of the continuous paper P.

Cooling Roll 79

The image forming surface of the continuous paper P is wound on the outer peripheral surface of the cooling roll 79 as illustrated in FIG. 1. Accordingly, the outer peripheral surface of the cooling roll 79 cools the continuous paper P through contact with the image-forming surface of the continuous paper P. The cooling roll 79 is driven to follow the continuous paper P that proceeds to the winding roll 74 side, and functions as a transport roller.

Second Image Forming Apparatus 12

The second image forming apparatus 12 is provided with an image forming apparatus main body 14 (housing), a second ejection unit 40 that ejects ink droplets (example of droplets) on the continuous paper P, a second drying unit 60 which causes the ink droplets ejected on the continuous paper P to dry, and a release unit 100 (refer to FIG. 2) that releases humidified air.

Second Drying Unit 60

The second drying unit 60 includes a housing 62 and an infrared ray heater (not shown) as a heat source disposed in the interior of the housing 62. Plural infrared ray beaters (not shown) are disposed along the vertical direction facing the image forming surface (surface on which ink droplets are ejected from the second ejection unit 40) of the continuous paper P transported in the interior of the housing 62. In the second drying unit 60, the ink on the image thrilling surface is dried by the plural infrared ray heaters (not shown) heating the image forming surface of the continuous paper P.

Second Ejection Unit 40

The second ejection unit 40 includes second ejection heads 42Y, 42M, 42C, and 42K (example of an ejecting mechanism) that eject each of yellow (Y), magenta (M), cyan (C), and black (K) ink droplets on the continuous paper P. An image is thrilled on the continuous paper P by each color of ink droplet being ejected on the continuous paper P from the second ejection heads 42Y, 42M, 42C, and 42K (below, referred to as 42Y to 42K).

The second ejection heads 42Y to 42K are in this order toward the upstream side in the transport direction of the continuous paper P. That is, the second ejection head 42K from the second ejection heads 42Y to 42K is disposed further to the upstream side in the transport direction, and the second ejection head 42Y is disposed further to the downstream side in the transport direction. Each of the second ejection beads 42Y and 42K has a length in the width direction (intersection direction that intersects the transport direction of the continuous paper P) of the continuous paper P.

Figure 2:
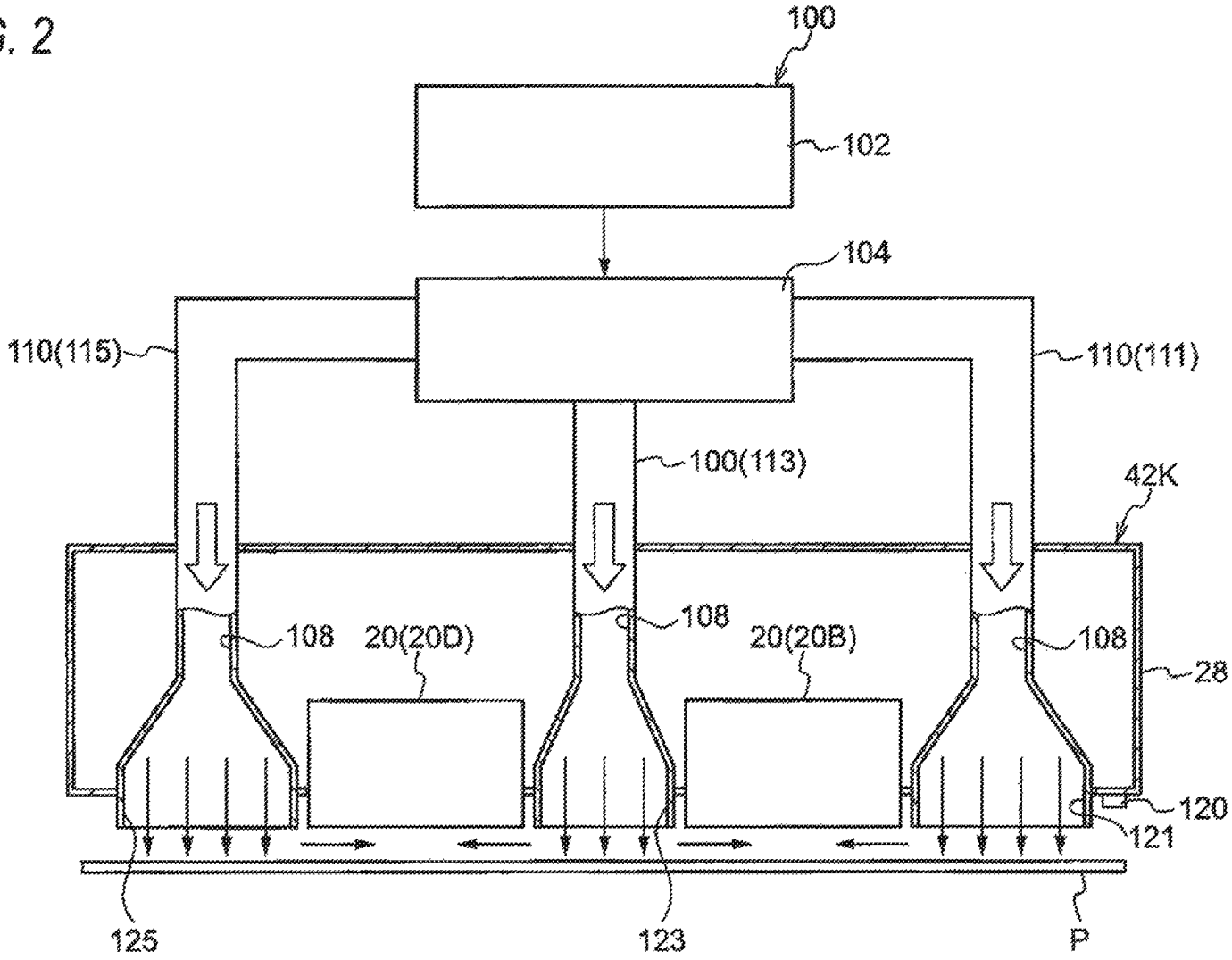
FIG. 2 is a schematic diagram illustrating a configuration of a release unit and an ejection head according to an exemplary embodiment viewed from the upstream side in the transport direction of a continuous paper.
Figure 3:
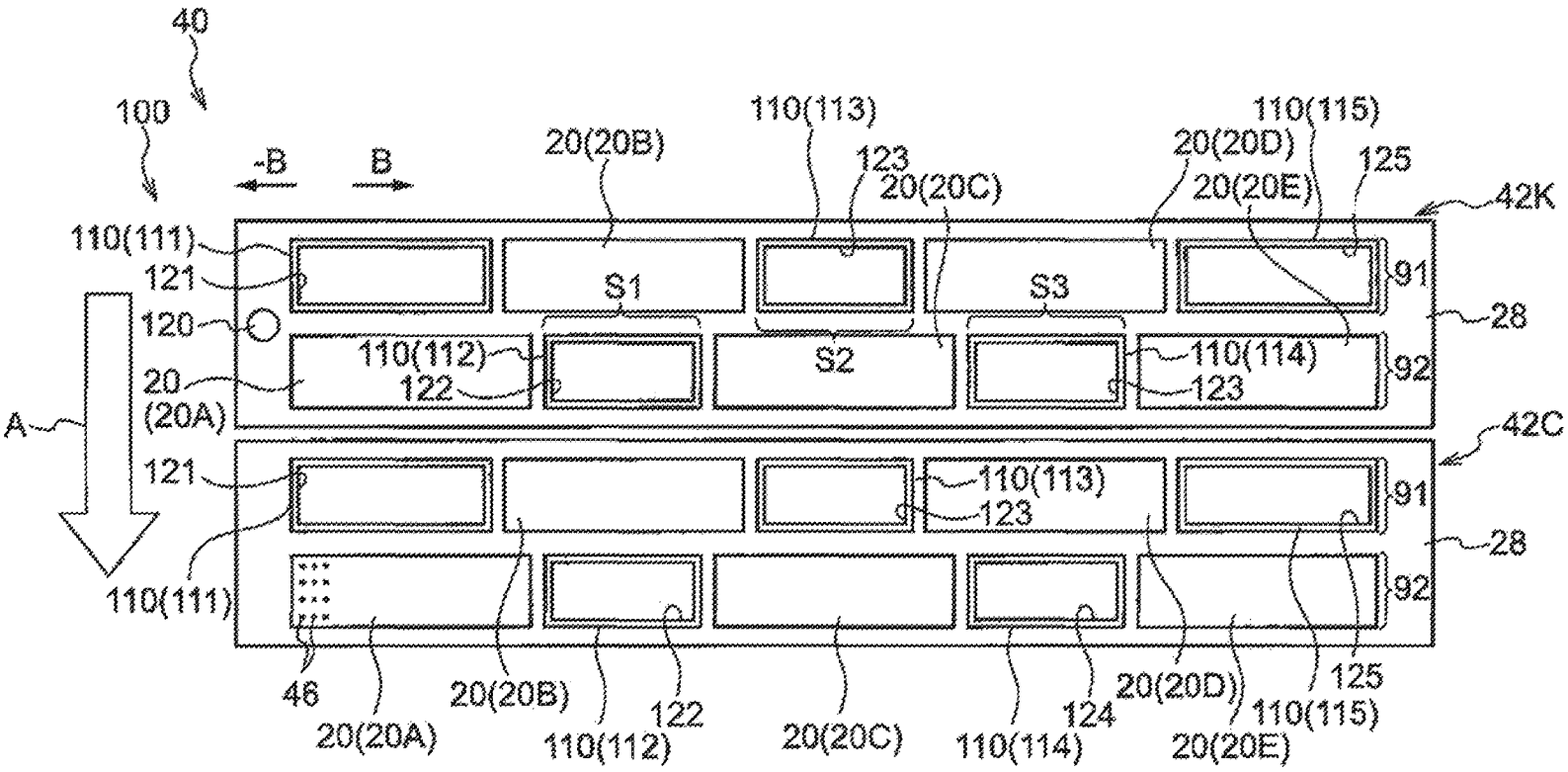
FIG. 3 is a bottom view illustrating the configuration of the release unit, and the ejection head according to an exemplary embodiment.

Each second ejection head 42Y to 42K flintier includes plural unit heads 20 that eject ink droplets from the nozzles 46 to the transported continuous paper P and a support member 28 that supports the plural unit heads 20, as illustrated in FIGS. 2 and 3. The support member 28 has a length along the width direction of the continuous paper P. Only a portion of the nozzles 46 is depicted in FIG. 3.

In the exemplary embodiment, each second ejection head. 42Y to 42K includes an odd number of five unit heads 20A, 20B, 20C, 20D, and 20E (below, referred to as 20A to 20E). The five unit beads 20A to 20E are disposed in a zig-zag pattern in the width direction (below, may be referred to simply as the width direction) of the continuous paper P. The width direction of the continuous paper P in each drawing is indicated, as appropriate, by the arrow B.

Specifically, the five unit heads 20A to 20E are disposed in a zig-zag pattern as outlined below. That is, the unit heads 20B and 20D from the five unit heads 20A to 20E are disposed with a gap S2 along the width direction of the continuous paper P, thereby forming a first row 91. The unit heads 20A, 20C and 20E are disposed with gaps S1 and S3 along the width direction of the continuous paper P, thereby forming the second row 92.

The first row 91 is disposed to the upstream side in the transport direction of the continuous paper P with respect to the second row 92. That is, the number of unit heads 20 disposed in the width direction of the continuous paper P on the upstream side in the transport direction is lower than the number of unit heads 20 disposed in the width direction of the continuous paper P on the downstream side in the transport direction.

The gap S2 of the first row 91 and the gaps S1 and S3 of the second row 92 are shifted in the width direction of the continuous paper P. The end portion in the longitudinal direction (end portion an the B direction side) of the n-th (except for the final number) unit head 20 and the end portion in the longitudinal direction of the n+1th (end portion on the −B direction side) unit head 20 are disposed overlapping viewed from the transport direction counting in the longitudinal direction (direction of arrow B) from one end portion (end portion in −B direction) in the longitudinal direction of each of the second ejection heads 42Y to 42K.

In this way, each of the second ejection heads 42Y to 42K have plural unit heads 20 disposed in a zig-zag pattern, and form a head unit (head module) with the plural unit heads 20.

Release Unit 100

The release unit 100 includes a humidifying device 102, an air blower 104, plural ducts 110, a humidity sensor 120 (hydroscope) as illustrated FIG. 2. Specifically, the release unit 100 includes five ducts 111, 112, 113, 114, 115 (below, referred to as 111 to 115) that is the same number as that of the unit heads 20 in each second ejection head 42Y to 42K, as illustrated in FIG. 3.

In FIG. 3, although the second ejection beads 42Y and 42M are not depicted, the second ejection heads 42Y and 42M are also formed similarly to the second ejection heads 42C and 42K in FIG. 3.

Each duct 111 to 115 is a formation member that forms a through path 108 (refer to FIG. 2). The ducts 111 to 115 each include release ports 121, 122, 123, 124, and 125 (below, referred to as 121 to 125) that are disposed adjacent to the unit heads 20, and that are open to the continuous paper P side.

The release ports 121 and 125 are each open in the upstream side in the transport direction with respect to unit heads 20A and 20E, and are disposed on the row of the first row 91.

The release ports 122 and 124 are respectively disposed in the gap S1 between the unit head 20A and 20C and the gap S3 between the unit head 20C and 20E in each second ejection head 42Y to 42K, when viewed from below as illustrated in FIG. 3 (seen from the nozzle 46 side).

The release port 123 is disposed in the gap S2 between the unit heads 20B and 20D in each second ejection head 42Y to 42K when viewed from below (seen from the nozzle 46 side).

In this way, the release ports 122, 123, and 124 are open to the continuous paper P side between the plural unit heads 20 in the width direction (longitudinal direction of the second ejection heads 42Y to 42K) of the continuous paper P. The release ports 121 to 125 are disposed in a zig-zag pattern in the width direction of the continuous paper P by being disposed as described above.

The humidity sensor 120 is disposed on the end portion in the longitudinal direction of any of the second ejection heads 42Y to 42K. In the example illustrated in FIG. 3, the humidity sensor 120 is disposed on the end portion in the longitudinal direction of the second ejection head 42K. The humidity sensor 120 measures the humidity at the end portion of the longitudinal direction of the second ejection head 42K, and transmits the measurement results (humidity information) to the controller 90. The controller 90 drives the humidifying device 102 and the air blower 104 in a case where the humidity measured by the humidity sensor 120 is lower than a predetermined reference humidity. The reference humidity is set to a range of 30% or more to 40% or less at 25° C.

When the humidifying device 102 is driven by the controller 90, water is evaporated due to heating and water vapor is generated. When the air blower 104 is driven by the controller 90, the water vapor generated by the humidifying device 102 passes through the through path 108 of each duct 111 to 115 along with air and is sent to the release ports 121 to 125. Accordingly, humidified air is released from the release ports 121 to 125.

The humidified air released from the release ports 121 to 125 is diffused in the periphery of the release ports 121 to 125 between the release ports 121 to 125 and the continuous paper P, and supplied to the space under the nozzle 46 of the unit head 20 in the periphery of the release ports 121 to 125. In particular, the humidified air released from the release ports 121 to 125 is carried to the downstream side in the transport direction by the air flow generated by the continuous paper P being transported. Therefore, much of the humidified air released from the release ports 121 to 125 is easily supplied to the space below the nozzle 46 of the unit head 20 on the downstream side in the transport direction with respect to the release ports 121 to 125.

It should be noted that it is desirable that gap between each of the second ejection heads 42Y to 42K be made smaller or embedded by an elastic body so that the humidified air does not escape.

Actions According to Exemplary Embodiment

Next the action according to the exemplary embodiment will be described.

In the exemplary embodiment, the humidifying device 102 and the air blower 104 are driven by the controller 90 in a case where the humidity measured by the humidity sensor 120 is lower than a predetermined reference humidity. Accordingly, the humidifying device 102 causes the water to be evaporated due to heating, thereby generating water vapor. The water vapor generated by the humidifying device 102 passes through the through path 108 of each duct 111 to 115 along with air and is sent to the release ports 121 to 125 by the air blower 104.

In this way, the humidified air is released from the release ports 121 to 125 by the water vapor and air being sent to the release ports 121 to 125. The humidified air released from the release ports 121 to 125 is diffused in the periphery of the release ports 121 to 125 between the release ports 121 to 125 and the continuous paper P, and supplied to the space under the nozzle 46 of the unit head 20 in the periphery of the release ports 121 to 125.

In the exemplary embodiment, the release ports 122, 123, and 124 are disposed between the unit heads 20 in the width direction (longitudinal direction of the second ejection heads 42Y to 42K) of the continuous paper P. Therefore, the release ports 122, 123, and 124 are closer with respect to the unit heads 20 disposed on both sides in the width direction with respect to the release ports 122, 123, and 124 than a configuration (comparative example) where the release ports 122, 123, and 124 are open at a position separated from the space between the unit heads 20 in the width direction of the continuous paper P.

Therefore, when the humidified air released from the release ports 122, 123, and 124 is diffused, the humidified air is more effectively supplied to the space below the nozzles 46 of the unit heads 20 disposed on both sides than the comparative examples, and drying of the nozzles 46 is suppressed.

In the exemplary embodiment, the release ports 122, 123, and 124 in the gaps S1, S2, and S3 between the unit heads 20 in the width direction (longitudinal direction of the second ejection heads 42Y to 42K) of the continuous paper P. That is, the release ports 122, 123, and 124 are disposed using the dead space of each second ejection head 42Y to 42K. Therefore, drying of the nozzles 46 is suppressed while maintaining sire reductions of each second ejection head 42Y to 42K.

In the exemplary embodiment, the number of unit heads disposed in the width direction of the continuous paper P on the upstream side in the transport direction is lower than the number of unit heads 20 disposed in the width direction of the continuous paper P on the downstream side in the transport direction.

Here, the humidified air released from the release ports 121 to 125 is carried to the downstream side in the transport direction by the air flow generated by the continuous paper P being transported. Accordingly, the humidified air is not easily supplied to the unit head 20 disposed on the upstream side in the transport direction.

In the exemplary embodiment, because there are few unit heads 20 on the upstream side in the transport direction which are not easily supplied with humidified air, the humidified air is more easily supplied to the unit head 20 and drying of the nozzles 46 is effectively suppressed compared to a case where the number of unit heads 20 on the upstream side in the transport direction is greater than the number of unit heads 20 on the downstream side in the transport direction.

The release unit 100 may have a configuration which does not include the ducts 111 and 115 (release ports 121 and 125). At least one of the ducts 112, 113, and 114 (release ports 122, 123, and 124) may be disposed in the release unit 100.

In the exemplary embodiment, although the release unit 100 is provided with respect to the second ejection heads 42Y to 42K, the release unit 100 instead or in addition may be provided with respect to the first ejection heads 32Y to 32K.

In the exemplary embodiment, although a continuous paper P is used as the recording medium, a cut sheet or the like in which the length in the transport direction is made a predetermined length may be used.

Release Unit 150 According to First Modification Example

Next, the release unit 150 according to the first modification example will be described. Below, the portions differing from the release unit 100 will be described, and description of the same parts as the release unit 100 will not be provided, as appropriate.

Figure 4:
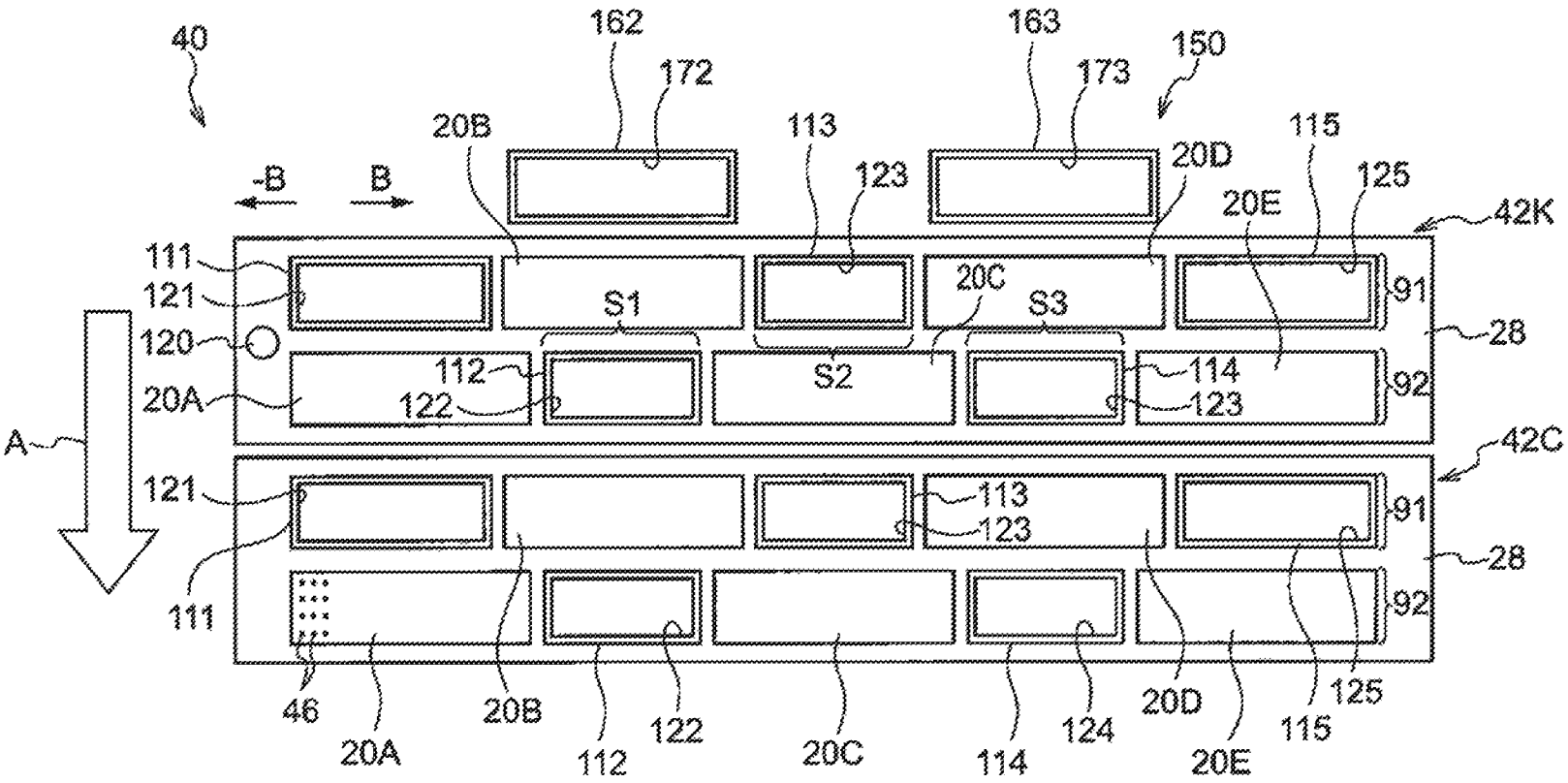
FIG. 4 is a bottom view illustrating the configuration of the release unit and the ejection head according to a first modification example.

The release unit 150 includes the ducts 162 and 163, as illustrated in FIG. 4, in addition to the humidifying device 102, air blower 104, humidity sensor 120, and the ducts 111 to 115 provided in second ejection head 42Y to 42K. The release unit 150 differs from the release unit 100 on the feature of having the ducts 162 and 163 in addition to the ducts 111 to 115.

The ducts 162 and 163 include release ports 172 and 173 that are disposed adjacent on the upstream side in the transport direction with respect to the unit heads 20B and 20D in the second ejection head 42K that is furthest to the upstream side in the transport direction, respectively. The release ports 172 and 173 are open to the continuous paper P side, similarly to the release ports 121 to 125.

Accordingly, the humidified air is released from the release ports 172 and 173, in addition to the release ports 121 to 125, in the release unit 150.

The humidified air released from the release ports 172 and 173 is transported to the downstream side in the transport direction by the air flow arising by the continuous paper P being transported, and is supplied to the space below the nozzles 46 of the unit heads 20B and 20D in the second ejection head 42K. Accordingly, drying of the nozzles 46 of the unit heads 20B and 20D is suppressed compared to a configuration not having the release ports 172 and 173.

It should be noted that the ducts 162 and 163 may be applied to the release unit 200 and the release unit 300, described later.

Release Unit 200 According to Second Modification Example

Next, the release unit 200 according to second modification example will be described. Below, the portions differing from the release unit 100 will be described, and description of the same parts as the release unit 100 will not be provided, as appropriate.

Figure 5:
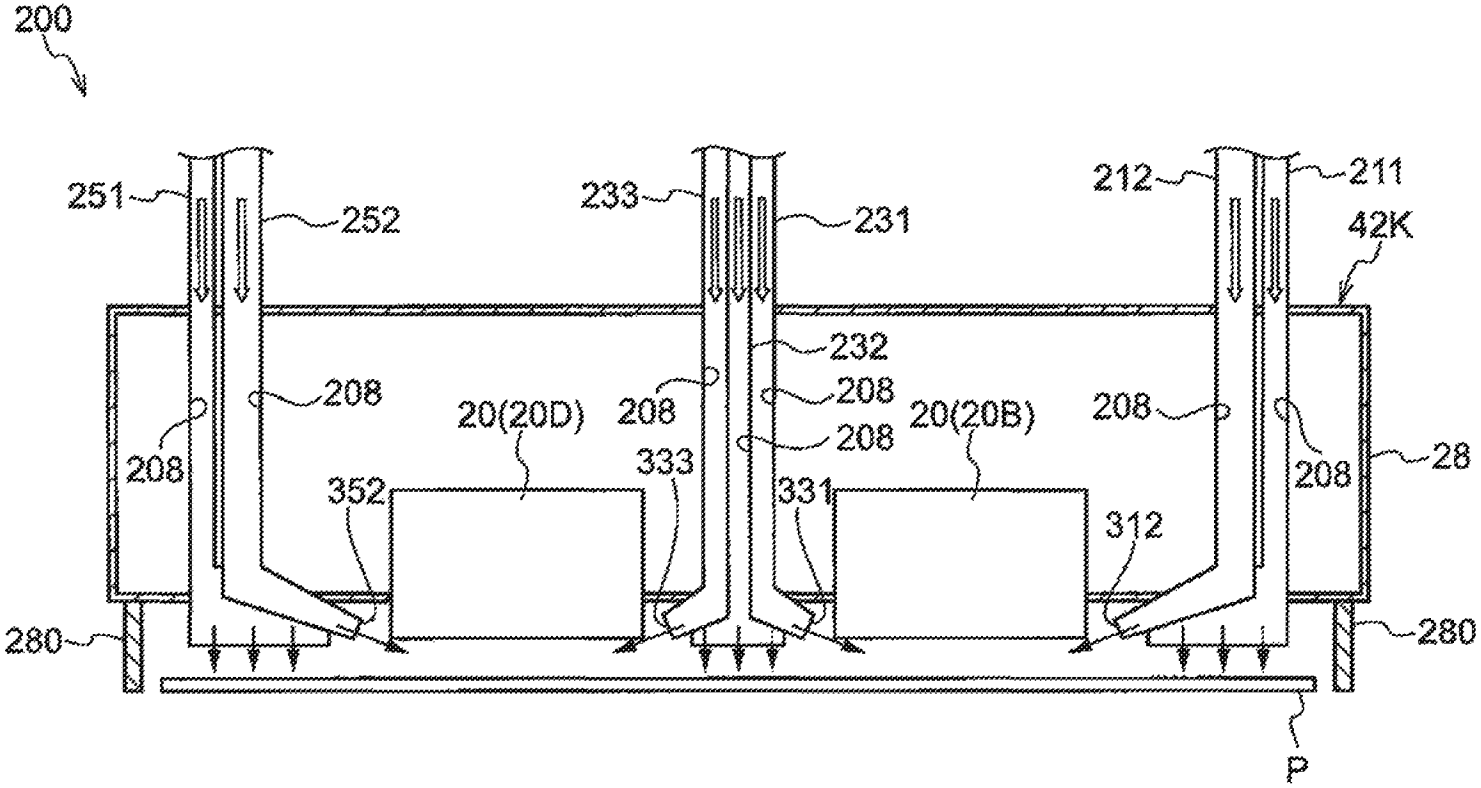
FIG. 5 is a schematic diagram illustrating a configuration of the release unit and the ejection head according to a second modification example viewed from the upstream side in the transport direction of a continuous paper.

The release unit 200 includes the ducts 211 to 212 in place of the duct 111 in the second ejection head 42K, includes the duets 231, 232, and 233 (below, referred to 231 to 233) in place of the duct 113, and includes the ducts 251 and 252, in place of the duct 115, as illustrated in FIG. 5.

Figure 6:
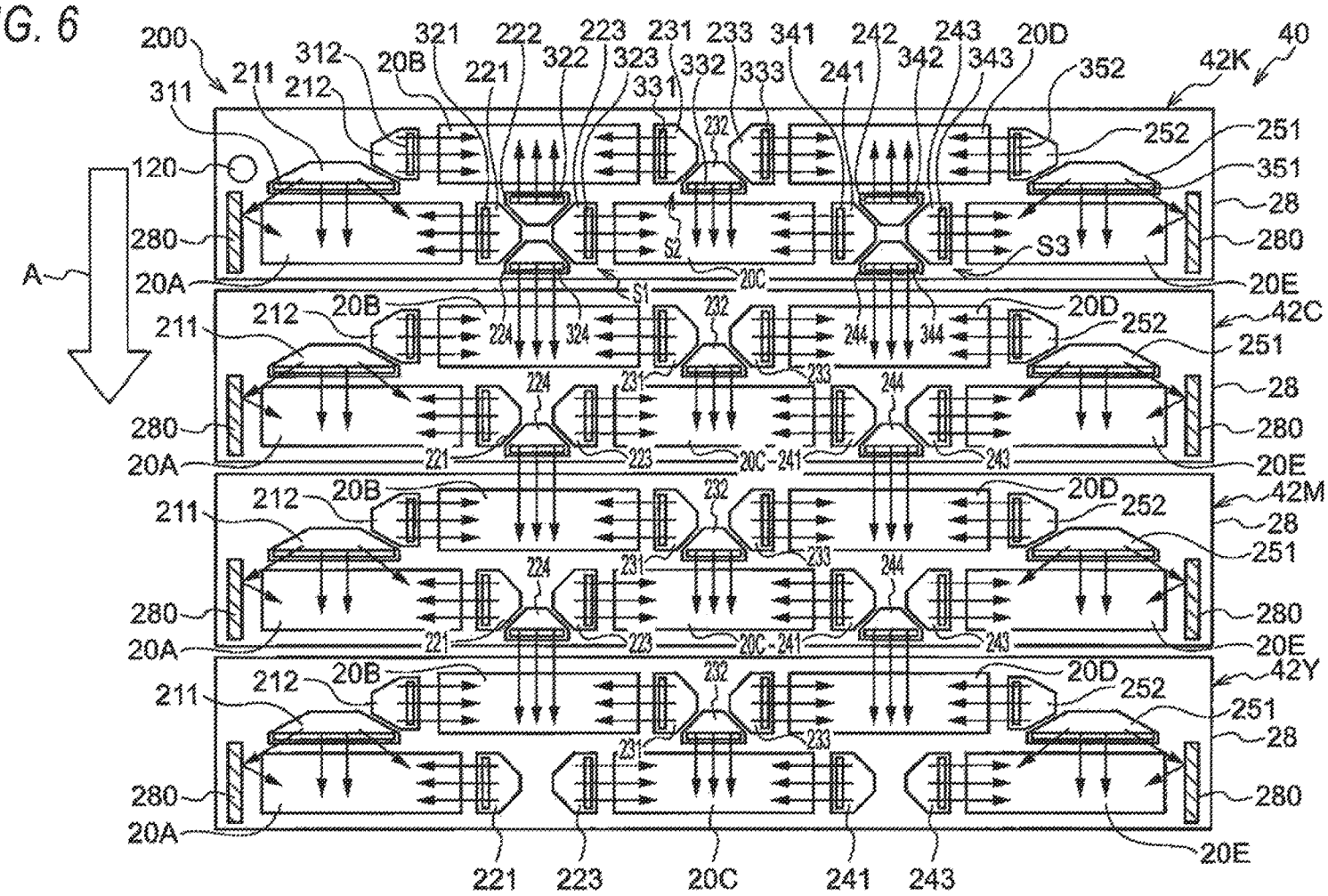
FIG. 6 is a bottom view illustrating the configuration of the release unit and the ejection head according to a second modification example.

The release unit 200 includes the ducts 221, 222, 223, and 224 (below, referred to as 221 to 224) in addition to the duct 112 in the second ejection head 42K, and includes the duets 241, 242, 243, and 244 (below, referred to 241 to 244) in place of the duct 114 as illustrated in FIG. 6.

The release unit 200 includes a pair of overhang portions 280 that are disposed on both end portions in the longitudinal direction of each second ejection head 42Y to 42K, and that overhang further to the lower side than the upper surface of the transported continuous paper P as illustrated in FIGS. 5 and 6. The pair of overhang portions 280 are, specifically, disposed on the outside in the longitudinal direction with respect to the unit heads 20A and 20E, adjacent to the unit heads 20A and 20E.

In the release units 200, the second ejection heads 42M and 42C are configured similarly to the second ejection head 42K, except for the feature of not including the ducts 222 and 242. The second ejection head 42Y is configured similarly to the second ejection head 42K, except for the feature of not including the ducts 222, 224, 242, and 244.

The ducts 221 to 224 are disposed on the unit head 20A side, on the upstream side in the transport direction, on the unit head 20C side, and on the downstream side in the transport direction spaced, respectively, with a gap S1. The ducts 221 to 224 respectively include the release ports 321, 322, 323, and 324 (below, referred to 321 to 324) facing the unit head 20A side, the upstream side in the transport direction, the unit head 20C, and the downstream side in the transport direction, when viewed from the nozzle 46 side of the unit head 20.

The release port 322, specifically, faces the unit head 20B side disposed an the upstream side in the transport direction with respect to the release port 322, viewed from the nozzle side of the unit head 20. The wind speed of the humidified air released from the release port 322 is made a speed exceeding ½ of the transport speed of the continuous paper P. The wind speed is set to a speed exceeding ½ of the transport speed of the continuous paper P by adjusting the cross-sectional area or the like of the duct 222 in advance.

The release port 324 of the second ejection heads 42K, 42C, and 42M, specifically, face the unit head 20B side in the second ejection heads 42C, 42M, and 42Y disposed on the downstream side in the transport direction, respectively.

The ducts 241 to 244 are disposed on the unit head 20C side, on the upstream side in the transport direction, on the unit bead 20E side, and on the downstream side in the transport direction spaced, respectively, with a gap S3. The ducts 241 to 244 respectively include the release ports 341, 342, 343, and 344 (below, referred to 341 to 344) facing the unit head 20C side, the upstream side in the transport direction, the unit bead 20E side, and the downstream side in the transport direction, when viewed from the nozzle 46 side of the unit head 20.

The release port 342, specifically, faces the unit head 20D side disposed on the upstream side in the transport direction with respect to the release port 342, viewed from the nozzle side of the unit head 20. The wind speed of the humidified air released from the release port 342 is made a speed exceeding ½ of the transport speed of the continuous paper P. The wind speed is set to a speed exceeding ½ of the transport speed of the continuous paper P by adjusting the cross-sectional area or the like of the duct 242 in advance.

The release port 344 of the second ejection heads 42K, 42C, and 42M, specifically, face the unit head 20D side in the second ejection heads 42C, 42M, 42Y disposed on the downstream side in the transport direction, respectively.

The ducts 211 and 212 are disposed adjacent to the unit head 20A and the unit head 20B, respectively. The ducts 211 and 212 include the release ports 311 and 312 that, face the unit head 20A side and the unit head 20B side, respectively, when viewed from the nozzle 46 side of the unit head 20.

The ducts 231 to 233 are disposed on the unit head 20B side, the unit head 20C side and the unit head 20D side, respectively, spaced with the gap S2. The ducts 231 to 233 respectively include the release ports 331, 332, and 333 (below, referred to 331 to 333) lacing the unit head 20B side, the unit head 20C side, and the unit head 20D side, when viewed from the nozzle 46 side of the unit head 20.

The ducts 251 and 252 are disposed adjacent to the unit head 20E and the unit head 20D, respectively. The ducts 251 and 252 include the release ports 351 and 352 that face the unit head 20E side and the unit head 20D side, respectively, when viewed from the nozzle 46 side of the unit bead 20.

In this way, in the release units 200, the respective release ports 321 to 324, 341 to 344, 311, 312, 331 to 333, 351, and 352 face their respective unit head 20 side. Therefore, the humidified air is more efficiently supplied to the space below the nozzle 46 of each unit head 20 than in a configuration (comparative example) in which each release port faces in the ejecting direction (downwards) of the nozzle 46. Accordingly, according to the release unit 200, drying of the nozzles 46 of each unit head 20 is better suppressed compared to the comparative examples.

The wind speed of the humidified air released from the release ports 322 and 324 in the release unit 200 is made a speed exceeding 112 of the transport speed of the continuous paper P. Here, an air flow arises by the continuous paper P being transported in the release unit 200, in a case where the air current is seen to be a Couette flow (flow within a gap when a gas fills a space between parallel plates placed in parallel having narrow gap therebetween and the parallel plate on one side moves in parallel at a constant speed), the average flow rate of the air current becomes approximately ½ of the transport speed of the continuous paper P.

Accordingly, because the wind speed of the humidified air released front the release ports 322 and 324 in the release unit 200 exceeds the average flow rate of the air current, the humidified air is more effectively supplied to the space below the nozzles 46 of the unit heads 20B and 20D in the second ejection head 42 that in a configuration in which the wind, speed of the humidified air released from the release port is a speed of 112 or lower of the transport speed of the continuous paper P. Accordingly, drying of the nozzles 46 of the unit beads 20B and 20D in the second ejection head 42 is better suppressed than in the comparative examples.

Since a pair of overhang portions 280 is included in the release unit 200, it difficult for the humidified air to escape to the outside in the longitudinal direction of each of the second ejection heads 42Y to 42K, and drying of the nozzle 45 of each unit head 20 is suppressed. In particular, since the pair of overhang portions 280 overhang further to the lower side than the upper surface of the continuous paper P, the humidified air does not escape to the outside and drying of the nozzle 46 of each unit head 20 is more effectively suppressed when compared to a configuration only overhanging further to the upper side than the upper surface of the continuous paper P.

It should be noted that the pair of overhang portions 280 may be provided in the above-described release units 100 and 200.

Release Unit 300 According to Third Modification Example

Next, the release unit 300 according to third modification example will be described. Below, the portions differing from the release unit 200 according to the second modification example will be described, and description of the same parts as the release unit 200 will not be provided, as appropriate.

Figure 7:
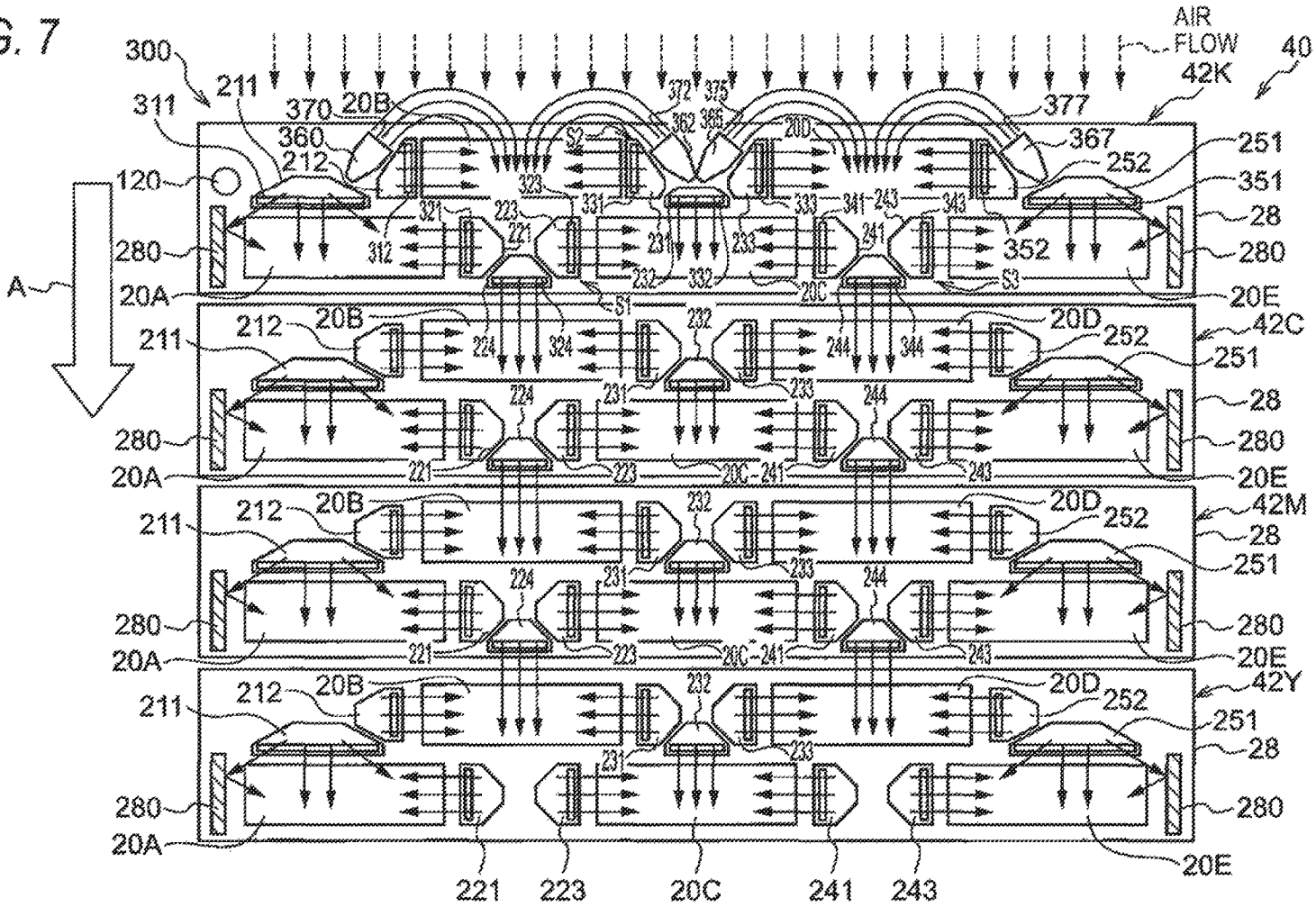
FIG. 7 is a bottom view illustrating the configuration of the release unit and the ejection head according to a third modification example.

The release unit 300 includes the ducts 360 and 362 in place of the duct 222 in the second ejection head 42K, and includes the ducts 365 and 367 in place of the duct 242, as illustrated in FIG. 7.

The ducts 360 and 362 are disposed on both sides in the longitudinal direction with respect to the unit head 20B. Specifically, the duet 360 is disposed on the side opposite (left side in FIG. 7) to the unit head 20B with respect to the duct 212. The duct 362 is disposed on the side opposite fright side in FIG. 7) to the unit head 20B with respect to the duct 231.

The duct 360 includes a release port 370 facing the upstream side in the transport direction with respect to the unit head 20B obliquely to the transport direction. That is, the release port 370 faces the upper side obliquely to the right in FIG. 7.

The duct 362 includes a release port 372 facing the upstream side in the transport direction with respect to the unit head 20B obliquely to the transport direction. That is, the release port 372 faces the upper side obliquely to the left in FIG. 7.

The ducts 365 and 367 are disposed on both sides in the longitudinal direction with respect to the unit head 20D. Specifically, the duct 365 is disposed on the side opposite (left side in FIG. 7) to the unit head 20D with respect to the duct 233. The duct 367 is disposed on the side opposite (right side in FIG. 7) to the unit head 20D with respect to the duct 252.

The duct 365 includes a release port 375 lacing the upstream side in the transport direction with respect to the unit head 20D obliquely to the transport direction. That is, the release port 375 races the upper side obliquely to the right in FIG. 7.

The duct 367 includes a release port 377 facing the upstream side in the transport direction with respect to the unit head 20D obliquely to the transport direction. That is, the release port 377 faces the upper side obliquely to the tell in FIG. 7.

In this way, the release ports 370, 372, 375, and 377 disposed on the end portion in the longitudinal direction with respect to the unit heads 20B, 20D in the release unit 300 face the upstream side in the transport direction with respect to the unit head 20B and 20D obliquely to the transport direction. Therefore, the humidified air released from the release ports 370, 372, 375 and 377 is sent to, the upstream side in the transport direction of the unit heads 20B and 20D. The humidified air released send to the upstream side in the transport direction of the unit heads 20B and 20D is transported to the downstream side in the transport direction by the air flow arising by the Continuous paper P being transported, and is supplied to the space below the nozzles 46 of the unit heads 20B and 20D in the second ejection head 42K. Accordingly, drying of the nozzle 46 of the unit heads 20B and 20D is better suppressed than a configuration in which the release ports 370, 372, 375, and 377 faces the unit-heads 20B and 20D alone the width direction of the continuous paper P.

It should be noted that although the release unit 300 includes the ducts 360 and 362 in place of the duet 222 in the second ejection head 42K, and includes the ducts 365, and 367 in place of the duct 242, the ducts 360, 362, 365, and 367 may be included in addition to the duets 222 and 242.

The foregoing description of the exemplary embodiments ref the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet ejection apparatus comprising:

an ejecting mechanism in which a plurality of ejection units that eject droplets from a nozzle to a transported recording medium are disposed in a zig-zag form in an intersection direction that intersects a transport direction of the recording medium; and a release unit that releases humidified air from a plurality of release ports which are open in the recording medium side between ejection units in the intersection direction, the release ports being disposed in a zig-zag pattern in the intersection direction.

2. The droplet ejection apparatus according to claim 1, wherein the release ports of the release unit face an ejection unit side when viewed from a nozzle side of the ejection unit.

3. The droplet ejection apparatus according to claim 2, wherein the release ports of the release unit face the ejection unit side disposed on an upstream side in the transport direction with respect to the release ports when viewed from the nozzle side of the ejection unit, and a wind speed of the humidified air released from the release ports is a speed greater than ½ of a transport speed of the recording medium.

4. The droplet ejection apparatus according to claim 1, wherein the ejecting mechanism includes an odd number of ejection units, and a number of ejection units disposed in the intersection direction on an upstream side in the transport direction is lower than the number of ejection units disposed in the intersection direction on a downstream side in the transport direction.

5. The droplet ejection apparatus according to claim 1, wherein the release unit further includes a release port disposed on the intersection direction side with respect to the ejection unit, and the release port obliquely faces an upstream side in the transport direction with respect to the ejection unit.

6. The droplet ejection apparatus according to claim 1, wherein the release unit further includes a release port disposed adjacent to an upstream side of the ejection unit on the furthest upstream side in the transport direction.

7. The droplet ejection apparatus according to claim 1, further comprising:

overhang portions that are disposed on one end portion and another end portion in the intersection direction in the ejecting mechanism, and that overhang further to a lower side than an upper surface of the recording medium.

8. The droplet ejection apparatus according to claim 1, wherein the release ports face a surface of the recording medium to which the droplets are ejected.

* * * * *